US008096248B2

(12) United States Patent
Kishi

(10) Patent No.: US 8,096,248 B2
(45) Date of Patent: Jan. 17, 2012

(54) EMBROIDERY DATA PROCESSING APPARATUS, EMBROIDERY SEWING MACHINE AND COMPUTER-READABLE RECORDING MEDIUM WITH RECORDED EMBROIDERY DATA PROCESSING PROGRAM

(75) Inventor: Motoshi Kishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 975 days.

(21) Appl. No.: 12/076,330

(22) Filed: Mar. 17, 2008

(65) Prior Publication Data

US 2008/0229988 A1 Sep. 25, 2008

(30) Foreign Application Priority Data

Mar. 23, 2007 (JP) ..... 2007-075755

(51) Int. Cl.
*D05B 21/00* (2006.01)

(52) U.S. Cl. ..... 112/102.5

(58) Field of Classification Search ..... 2/84, 85, 2/89, 98, 99, 102, 102.5; 83/660, 866
See application file for complete search history.

(56) References Cited

U.S. PATENT DOCUMENTS

| | | | | |
|---|---|---|---|---|
| 268,170 | A * | 11/1882 | Baum | 112/89 |
| 938,884 | A * | 11/1909 | Moriggl | 112/89 |
| 5,065,682 | A * | 11/1991 | Tajima et al. | 112/103 |
| 7,966,956 | B2 * | 6/2011 | Suzuki et al. | 112/98 |

FOREIGN PATENT DOCUMENTS

| | | |
|---|---|---|
| JP | U-58-4695 | 1/1983 |
| JP | U-63-81888 | 5/1988 |
| JP | U-63-85695 | 6/1988 |
| JP | A-6-81263 | 3/1994 |

* cited by examiner

*Primary Examiner* — Tejash Patel
(74) *Attorney, Agent, or Firm* — Oliff & Berridge, PLC

(57) ABSTRACT

The present disclosure provides an embroidery data processing apparatus that processes embroidery data for sewing an embroidery to a work cloth and to make a cut by a boring knife. The embroidery data processing apparatus an embroidery data acquisition device that acquires the embroidery data, pieces of the embroidery data including at least thread color data specifying a color of an embroidery thread and needle drop point data specifying a sewing position where sewing is performed with the embroidery thread specified by the thread color data; a specification device that specifies, as data of a specified color, a predetermined thread color data piece of the thread color data in the acquired embroidery data, which is the embroidery data acquired; and a boring data setting device that sets a needle drop point data piece of the needle drop point data, corresponding to the specified color data specified as boring data that specifies a position for the cut.

12 Claims, 18 Drawing Sheets

FIG. 7

| COMMAND | DATA |
|---|---|
| COLOR CHANGEOVER | INDIGO BLUE |
| SEWING DATA | Xa0,Ya0 |
| SEWING DATA | Xa1,Ya1 |
| SEWING DATA | Xa2,Ya2 |
| : | |
| : | |
| SEWING DATA | XaN,YaN |
| COLOR CHANGEOVER | BLUE |
| SEWING DATA | Xb0,Yb0 |
| SEWING DATA | Xb1,Yb1 |
| SEWING DATA | Xb2,Yb2 |
| : | |
| : | |
| : | |
| SEWING DATA | XbN,YbN |
| COLOR CHANGEOVER | BLUE GREEN |
| SEWING DATA | Xc0,Yc0 |
| SEWING DATA | Xc1,Yc1 |
| SEWING DATA | Xc2,Yc2 |
| : | |
| : | |
| : | |
| : | |
| : | |
| : | |
| SEWING DATA | XcN,YcN |
| COLOR CHANGEOVER | INDIGO PURPLE |
| SEWING DATA | Xd0,Yd0 |
| SEWING DATA | Xd1,Yd1 |
| SEWING DATA | Xd2,Yd2 |
| : | |
| : | |
| SEWING DATA | XdN,YdN |
| COLOR CHANGEOVER | RED |
| SEWING DATA | Xe0,Ye0 |
| SEWING DATA | Xe1,Ye1 |
| SEWING DATA | Xe2,Ye2 |
| : | |
| : | |
| SEWING DATA | XeN,YeN |
| : | |
| : | |
| : | |

| | |
|---|---|
| : | |
| : | |
| : | |
| COLOR CHANGEOVER | INDIGO BLUE |
| SEWING DATA | Xf0,Yf0 |
| SEWING DATA | Xf1,Yf1 |
| SEWING DATA | Xf2,Yf2 |
| : | |
| : | |
| SEWING DATA | XfN,YfN |
| COLOR CHANGEOVER | BLUE |
| SEWING DATA | Xg0,Yg0 |
| SEWING DATA | Xg1,Yg1 |
| SEWING DATA | Xg2,Yg2 |
| : | |
| : | |
| : | |
| SEWING DATA | XgN,YgN |
| COLOR CHANGEOVER | BLUE GREEN |
| SEWING DATA | Xh0,Yh0 |
| SEWING DATA | Xh1,Yh1 |
| SEWING DATA | Xh2,Yh2 |
| : | |
| : | |
| : | |
| : | |
| : | |
| : | |
| SEWING DATA | XhN,YhN |
| COLOR CHANGEOVER | INDIGO PURPLE |
| SEWING DATA | Xi0,Yi0 |
| SEWING DATA | Xi1,Yi1 |
| SEWING DATA | Xi2,Yi2 |
| : | |
| : | |
| SEWING DATA | XiN,YiN |
| COLOR CHANGEOVER | RED |
| SEWING DATA | Xj0,Yj0 |
| SEWING DATA | Xj1,Yj1 |
| SEWING DATA | Xj2,Yj2 |
| : | |
| : | |
| SEWING DATA | XjN,YjN |

EMBROIDERY DATA PROCESSING APPARATUS, EMBROIDERY SEWING MACHINE AND COMPUTER-READABLE RECORDING MEDIUM WITH RECORDED EMBROIDERY DATA PROCESSING PROGRAM

CROSS-REFERENCE TO RELATED APPLICATION

The present application claims priority to Japanese Patent Application No. 2007-075755, filed on Mar. 23, 2007, the entire disclosure of which is incorporated herein by reference in its entirety.

BACKGROUND

The present disclosure generally relates to an embroidery data processing apparatus, an embroidery sewing machine, and a computer-readable recording medium storing embroidery data processing program. More particularly, the present disclosure relates to processing the embroidery data in which a setting for boring can be made.

Conventionally, a technique (eyelet embroidering) has been available for embroidering by use of an embroidery sewing machine, by sewing an embroidery around a cut (hole) in a piece of work cloth. Such a cut has been formed by attaching to the lower end of a needle bar, a boring apparatus that is fitted with a boring knife that has a cutting tooth formed at its tip, and by inserting the boring knife through a piece of work cloth sandwiched between a pair of embroidery frames that feed the piece of work cloth (see, for example, Japanese Utility Model Application Laid-Open Publication No. SHO 63-81888). The specific position of such a cut by a boring knife is performed by a method of setting the number of a needle bar fitted with the boring apparatus and then by incorporating a setting for the specific boring data into sewing data of a boring-specified sewing order.

SUMMARY

However, if the embroidery data contains a plurality of sewing procedures for a boring-specified sewing order, the aforementioned boring setting method has been troublesome because it requires setting the specific boring data for each of those sewing procedures.

To address those problems, the present disclosure has been developed, and it is an object of the present disclosure to enable a one time setting of the boring data for each of a plurality of sewing orders.

To address the above problem, a first aspect of the present disclosure provides an embroidery data processing apparatus that processes embroidery data used to sew an embroidery to a work cloth and makes a cut with a boring knife. The embroidery data processing apparatus includes: an embroidery data acquisition device that acquires the embroidery data, which includes at least thread color data specifying a color of an embroidery thread and needle drop point data specifying a sewing position where sewing is performed with the embroidery thread specified by the thread color data; a specification device that specifies, as data of a specified color, a predetermined thread color data piece of the thread color data pieces included in the acquired embroidery data, which is the embroidery data acquired by the embroidery data acquisition device; and a boring data setting device that sets a needle drop point data of the needle drop point data pieces that is included in the acquired embroidery data, corresponding to the specified color data specified by the specification device, as boring data which specifies a position where the cut is made by the boring knife.

A second aspect of the present disclosure provides an embroidery data processing apparatus that processes embroidery data used to sew an embroidery to a work cloth and makes a cut with a boring knife. The embroidery data processing apparatus includes: a thread color data storage device that stores thread color data specifying a color of an embroidery thread; a specification device that specifies, as data of a specified color, a predetermined thread color data piece of the thread color data pieces stored in the thread color data storage device; an embroidery data storage device that stores the embroidery data which includes at least the thread color data specifying the color of the embroidery thread and needle drop point data specifying a sewing position where sewing is performed with the embroidery thread specified by the thread color data; an embroidery data selection device that selects a predetermined embroidery data from among the embroidery data pieces stored in the embroidery data storage device; and a boring data setting device. The boring data setting device sets needle drop point data corresponding to the specified color data as boring data which specifies a position where the cut is made by the boring knife, if there is the specified color data specified by the specification device in the thread color data of the embroidery data selected by the embroidery data selection device.

A third aspect of the present disclosure provides an embroidery sewing machine provided with a boring function that sews an embroidery to a work cloth that has a cut made by a boring knife. The embroidery sewing machine comprising: a sewing device that forms stitches; a movement device that moves the work cloth; the embroidery data processing apparatus described above; a boring knife that makes a cut in the work cloth; a boring control device that makes the cut in the work cloth by moving the work cloth with the movement device while moving the boring knife up and down based on boring data which is set by the boring data setting device; and an embroidery control device that controls the sewing device and the movement device based on the acquired embroidery data so that embroidery may be performed.

A fourth aspect of the present disclosure provides a computer-readable recording medium storing a control program for use in an embroidery data processing apparatus which processes embroidery data used to sew an embroidery to a work cloth and makes a cut with a boring knife. The control program comprising: embroidery data acquisition instructions for acquiring the embroidery data which includes at least thread color data specifying a color of an embroidery thread and needle drop point data specifying a sewing position where sewing is performed with the embroidery thread specified by the thread color data; specification instructions for specifying, as data of a specified color, a predetermined thread color data piece of the thread color data pieces included in the acquired embroidery data, which is the embroidery data acquired by the embroidery data acquisition instructions; and boring data setting instructions for setting a piece of the needle drop point data, piece of the needle drop point data pieces included in the acquired embroidery data, corresponding to the specified color data specified by the specification instructions, as boring data which specifies a position where the cut is made by the boring knife.

A fifth aspect of the present disclosure provides a computer-readable recording medium storing a control program for use in an embroidery data processing apparatus, which processes embroidery data used to sew an embroidery to a work cloth and makes a cut by a boring knife. The control program includes: thread color data storage instructions for storing thread color data specifying a color of an embroidery thread; specification instructions for specifying, as data of a specified color, a predetermined thread color data piece of the thread color data pieces stored by the thread color data storage instructions; embroidery data storage instructions for storing the embroidery data which includes at least the thread color data specifying the color of the embroidery thread and needle drop point data specifying a sewing position where sewing is performed with the embroidery thread specified by the thread color data; embroidery data selection instructions for selecting a predetermined embroidery data from among the embroidery data pieces stored by the embroidery data storage instructions; and boring data setting instructions for setting needle drop point data corresponding to the specified color data as boring data which specifies a position where the cut is made by the boring knife, if there is the specified color data specified by the specification instructions in the thread color data of the embroidery data selected by the embroidery data selection instructions.

BRIEF DESCRIPTION OF THE DRAWINGS

Exemplary examples of the invention is described below in detail with reference to the accompanying drawings in which:

FIG. 7 is a table showing an example of sewing data;

DETAILED DESCRIPTION

The following describes an example of the present disclosure with reference to the drawings. The present example is one example of an application of a multi-needle type embroidery sewing machine 11 that is equipped with six needle bars to enable sewing with six kinds of threads supplied from thread spools to sewing needles fitted to those needle bars, respectively.

First, one example of the multi-needle type embroidery sewing machine 11 is described below with reference to FIGS. 1-4. It should be noted that in FIGS. 1 and 2, the side toward the user is referred to as "front side of the sewing machine 11" and the side away from the user is referred to as "rear side of the sewing machine 11". Further, the right and left directions as viewed from the user are referred to as the right and left directions.

Figure 1:
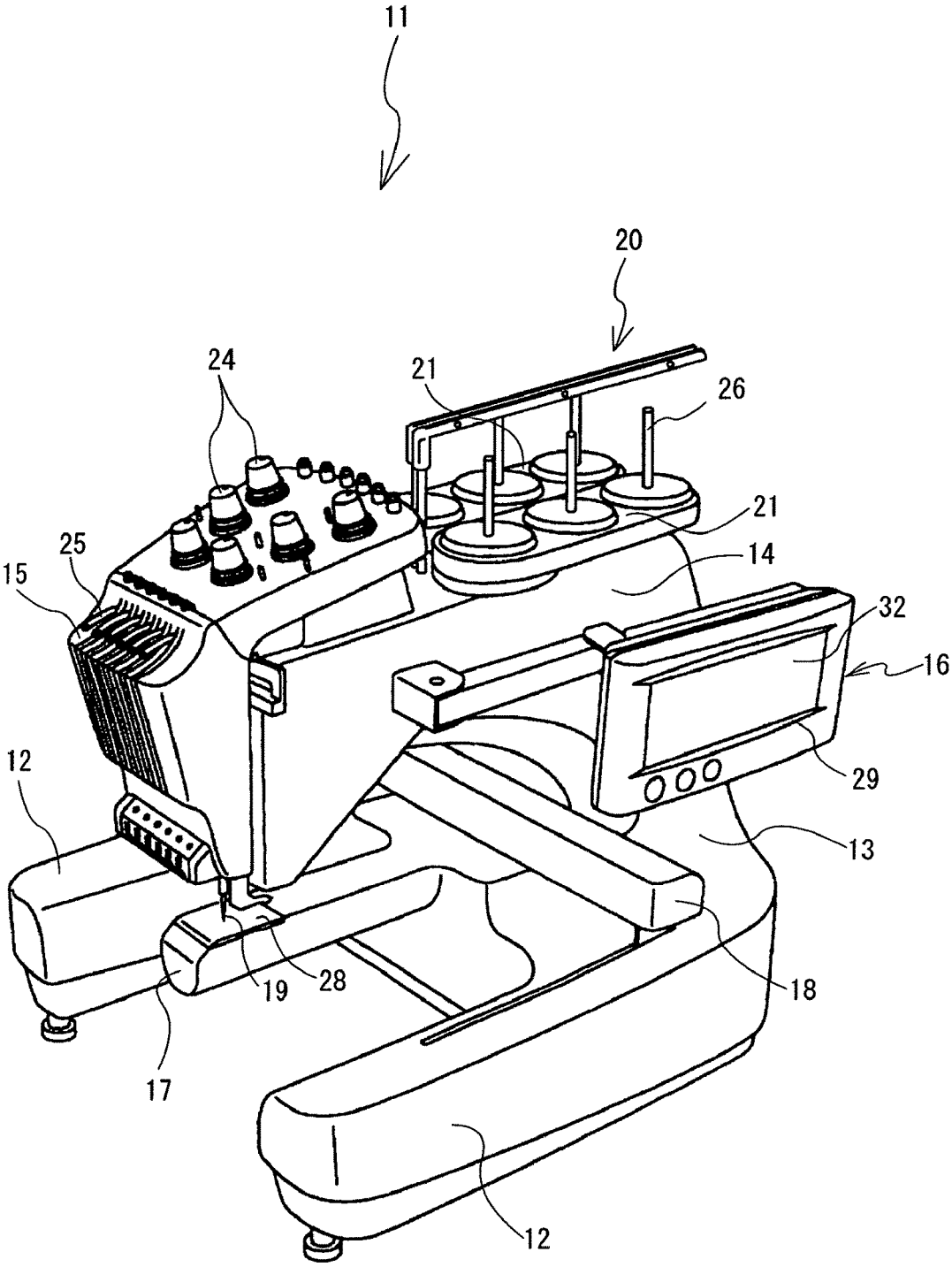
FIG. 1 is a perspective view of a multi-needle type embroidery sewing machine according to an example of the present disclosure.
Figure 2:
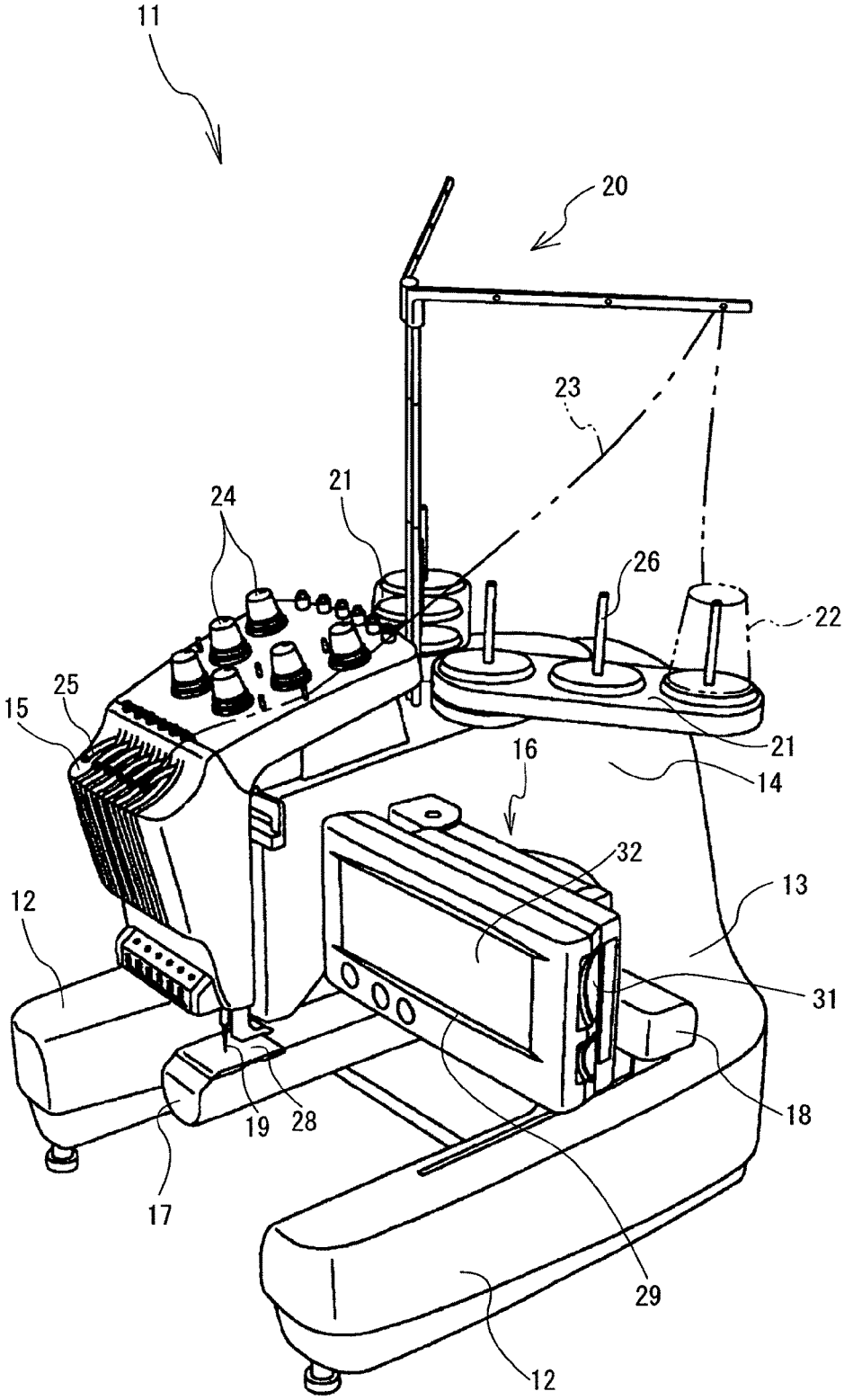
FIG. 2 is a perspective view of the multi-needle type embroidery sewing machine in a condition where a thread spool table is at its use position.

As shown in FIGS. 1 and 2, the multi-needle type embroidery sewing machine 11 may be equipped with a support portion 12, a pillar portion 13, an arm portion 14, and a needle bar case 15. The support portion 12 may support the multi-needle type embroidery sewing machine 11. The pillar portion 13 may be erected upward from the support portion 12. The arm portion 14 may extend toward the front side from an upper end of the pillar portion 13. The needle bar case 15 may be attached to an end of the arm portion 14 movable in the right and left directions. At the right-of-center position of the arm portion 14, an operation portion 16 may be provided, which is axially supported by the arm portion 14, and may be switched between a housing position shown in FIG. 1 and an operation position shown in FIG. 2. Inside the arm portion 14 are mounted main shaft 74 (see FIG. 3), which may be rotary-driven by a sewing machine motor 54 (see FIG. 5), and a needle bar drive mechanism 67 (see FIG. 5), which may be driven by the main shaft 74. Further, at the lower part of the arm portion 14, a cylinder bed portion 17 may be provided, that extends toward the front side from the lower end of the pillar portion 13. A shuttle drive mechanism 58 (see FIG. 5) may be mounted at the front part of the inside of the cylinder bed 17. The shuttle drive mechanism 58 drives a shuttle 59 (see FIG. 5) that accommodates a bobbin winding that winds a bobbin thread (not shown). Further, a needle plate 28 may be provided on the upper surface of the front side of the cylinder bed 17. The multi-needle type embroidery sewing machine 11 may be equipped with an embroidery frame right-and-left movement mechanism 18 and an X-axis motor 63 (see FIG. 5). The embroidery frame right-and-left movement mechanism 18, which may be disposed in such a manner as to be stretched over the right and left support sides portions 12, may move an embroidery frame (not shown) in the right and left directions. On the other hand, the X-axis motor 63 may drive the embroidery frame right-and-left movement mechanism 18. The multi-needle type embroidery sewing machine 11 may be further equipped with an embroidery frame back-and-forth movement mechanism 68 (see FIG. 5) and a Y-axis motor 64 (see FIG. 5). The embroidery frame back-and-forth movement mechanism 68, which may be contained in each of the right and left support portions 12, may move the embroidery frame right-and-left movement mechanism 18 in the back and front directions. On the other hand, the Y-axis motor 64 may drive the embroidery frame back-and-forth movement mechanism 68. When sewing an embroidery, the embroidery frame to which a work cloth is attached is set to a carriage (not shown) of the embroidery frame right-and-left movement mechanism 18 and moved in the right and left directions and the back and front directions by the X-axis motor 63 and the Y-axis motor 64, respectively. Hereinafter, the components of the multi-needle type embroidery sewing machine are described in detail.

First, a thread spool table 21 that may be provided on the rear part on the upper surface of the arm portion 14 is described below with reference to FIGS. 1 and 2. As shown in FIGS. 1 and 2, on the rear part of the upper surface of the arm portion 14, a pair of right and left thread spool tables 21 may be provided, and to each of which a plurality of thread spools 22 may be attached. Corresponding to the thread spool tables 21, a thread guide mechanism 20 may be provided. The thread spool tables 21 and the thread guide mechanism 20 may be each configured in such a manner that they can be switched between a housing position and a use position. In the housing position, they are folded roughly parallel to the back and front directions of the multi-needle type embroidery sewing machine 11, as shown in FIG. 1. In the use position, as viewed from the top, they are open toward the rear side of the multi-needle type embroidery sewing machine 11, as shown in FIG. 2. Each of the thread spool tables 21 may be provided with three thread spool pins 26 to which the three thread spools 22 can be fitted, respectively. The pair of right and left thread spool tables 21 may support a total of six thread spools 22, which may correspond to the number of the sewing needles 19. A needle thread 23 extending from each of the thread spools 22 that are attached to the thread spool table 21 may be supplied to each of the sewing needles 19 via the thread guide mechanism 20 that prevents the needle thread 23 from being tangled. A tensioner 24 may adjust the tension of the thread, via a thread take-up lever 25 that pulls up the needle thread by reciprocating up and down, etc.

Figure 3:
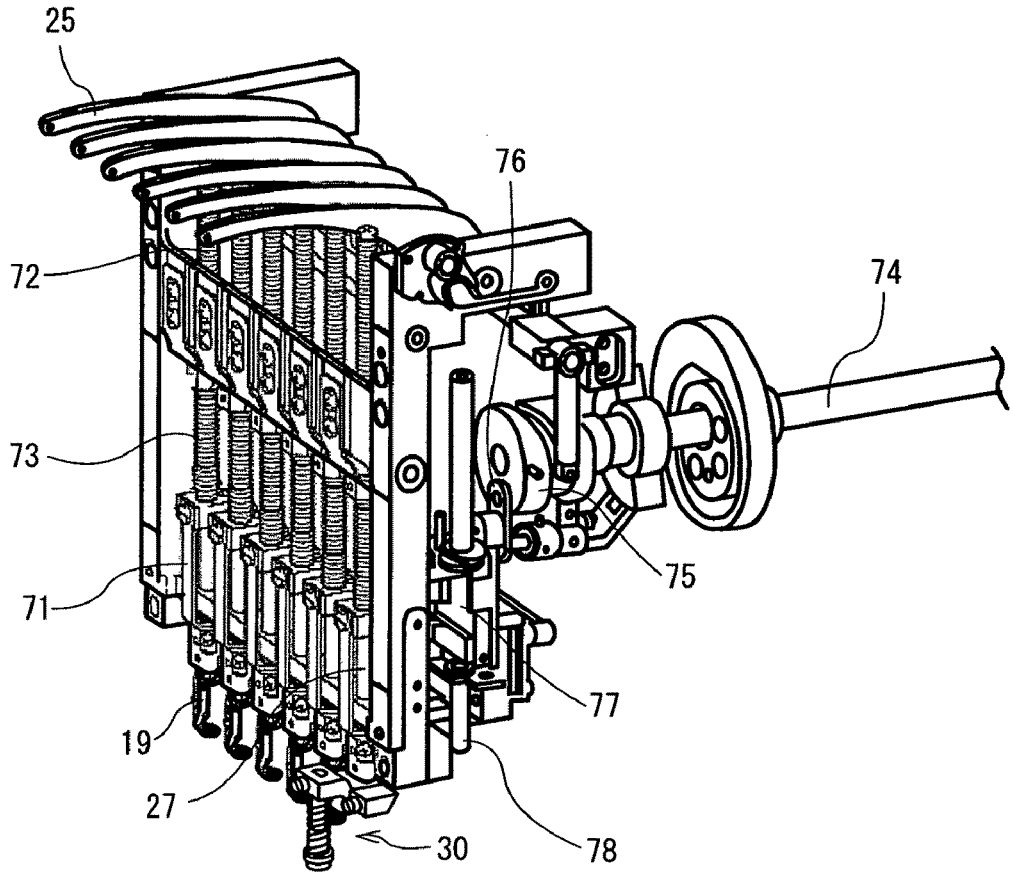
FIG. 3 is a perspective view of an internal structure of a needle bar case in the multi-needle type embroidery sewing machine.

Next, an inner configuration of the needle bar case 15 provided on the front surface of the arm portion 14 is described below with reference to FIG. 3. As shown in FIG. 3, within the needle bar case 15, the six needle bars 27 may be provided, and to the lower end of each needle bar, the sewing needle 19 may be equipped. The needle bars 27 may be supported in such a manner that each can slide in the up and down directions, by two upper and lower fixation members, which are fixed to the frame of the needle bar case 15. Further, to the lower end of the needle bar 27, a presser foot 71 may be attached, which may be capable of sliding up and down. Each needle bar 27 may be fitted with a presser spring 72 on its upper half and a presser spring 73 on its lower half.

Figure 4:
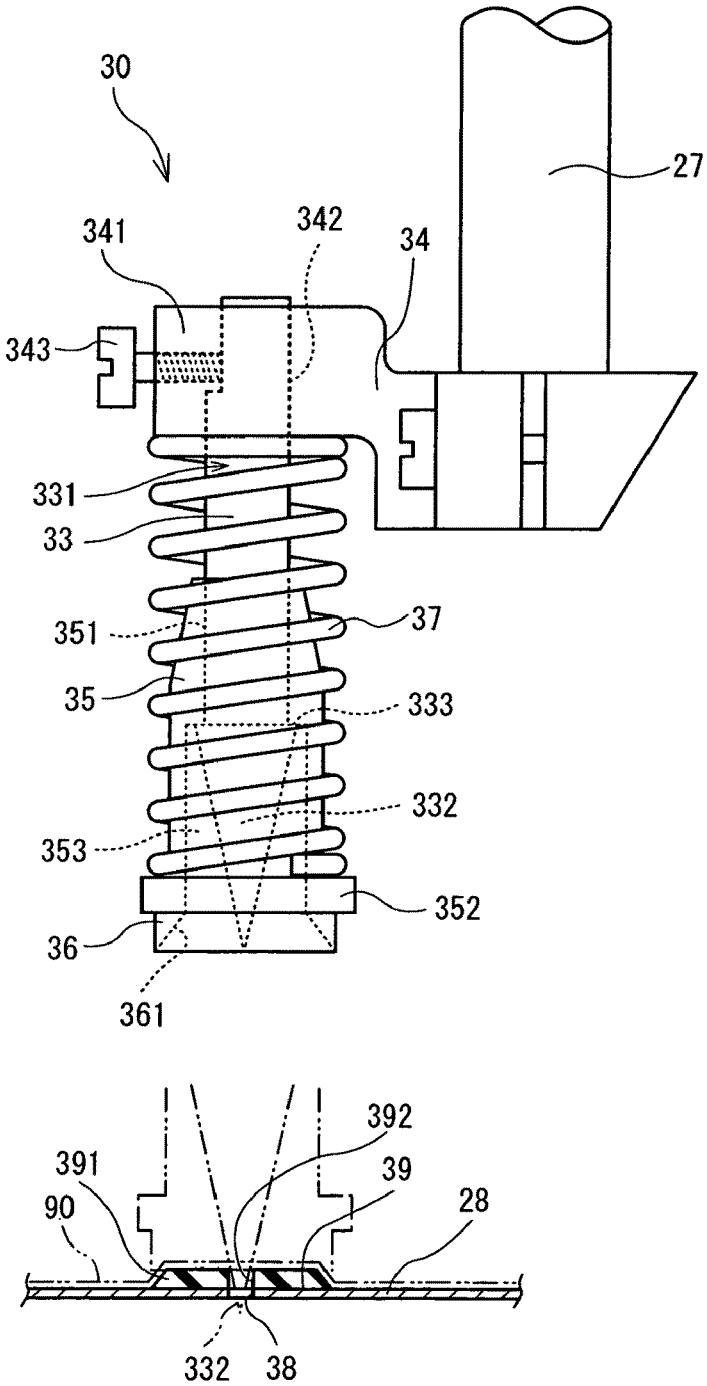
FIG. 4 is an expanded side view of components of a boring apparatus in the multi-needle type embroidery sewing machine.

Further, as shown in FIG. 3, in place of a sewing needle 19, a boring apparatus 30, which may be attached to the needle bar 27, may be equipped to make a cut (eyelet) in a piece of cloth. The boring apparatus 30 may be attached to the right-most needle bar 27 (which may be assigned needle bar No. 1) in FIG. 3. Now the boring apparatus 30 is described below with reference to FIG. 4. As shown in FIG. 4, the boring apparatus 30 includes a boring knife 33, a presser 35, and a spring 37. The boring knife 33 may be attached to the needle bar 27 with a holder 34. The presser 35 may be fitted to the boring knife 33 in such a manner that it may be slidable. The spring 37 may be disposed around the presser 35. Further, a grip ring 36 may be attached to the lower end of the presser 35.

The boring knife 33 may be inserted perpendicularly into an attachment hole 342 by a screw 343. The attachment hole 342 may be formed in an arm portion 341 of the holder 34, and extends leftward, as shown in the FIG. 4. The boring knife 33 has a base 331 formed like a round bar at its top and a cutting tooth 332 formed like a cone at its bottom. Further, the cutting tooth 332 has its upper end whose outer diameter may be larger than that of the base 331, in such a configuration that a step portion 333 may be formed at a boundary between the base 331 and the cutting tooth 332. The cutting tooth 332 may have four edge lines that are tapered centripetally so that an eyelet may be formed in a cross-shape by sticking the cutting tooth 332 into a work cloth 90.

The presser 35 has a fitting hole 351 formed at its upper part so that the base 331 of the boring knife 33 may be fitted into it. Further, around an outer periphery near the lower end of the presser 35, a protruding strip 352 may be provided annularly. At the lower part of the presser 35, a cavity 353 may be formed so as to protect the cutting tooth 332 of the boring knife 33. Further, the upper end surface of the cavity 353 may abut against the step portion 333 of the boring knife 33, in order to restrict the lowering of the presser 35.

The grip ring 36 may be annularly shaped and formed with an elastic material, such as rubber or a synthetic resin, in order to improve the effect of gripping against the work cloth 90. On the inner periphery surface of the lower end of the grip ring 36, a taper surface 361 may be formed that abuts against the work cloth 90.

Further, the needle plate 28 may have an escape hole 38 formed in it so that the cutting tooth 332 of the boring knife 33 may enter it. On the upper surface of the needle plate 28 around the escape hole 38, a grip plate 39, may be attached. The grip plate 39 cooperates with the presser 35 to annually grip the eyelet formed in the work cloth 90. The grip plate 39 may be formed with a disk shape by using an elastic material such as rubber or a synthetic resin. On the peripheral surface of the disk, a grip surface 391, may be formed in a tapered shape, which is engaged with the taper surface 361 of the grip ring 36. Further, at the center of the disk, a through-hole 392 may be formed that has a shape similar to that of the cutting tooth 332 of the boring knife 33, so that the cutting tooth 332 can enter the through-hole 392 in close contact.

Next, the operation portion 16, which may be axially supported by the arm portion 14, is described below with reference to FIGS. 1 and 2. The operation portion 16 may be provided with a liquid crystal display (LCD) 29 that displays thread information, embroidery patterns, etc., and a memory card connector 31 to which a memory card (not shown) may be inserted, etc. The LCD 29 may display the thread information of a thread that may be assigned to the needle bar 27 (see FIGS. 3 and 4), embroidery data of what is to be sewed, thread bar numbers and thread information corresponding to the needle bar 27 that may be subject to thread replacement, function names of a variety of functions enabling sewing operations, and various messages, etc. The LCD 29 may be fitted with a touch panel 32 on its front surface. If the user selects any items displayed on the LCD 29 with his finger or a dedicated pen to, the touch panel 32 detects those items so that various commands can be entered.

Next, the operations of forming stitches to the work cloth attached to the embroidery frame (not shown), which may be supported by the embroidery frame movement mechanism 18 (see FIG. 2), is described below with reference to FIGS. 1-3. First, when the needle bar case 15 moves right and left, one of the six needle bars 27 may be selected. Then, the sewing machine motor 54 (see FIG. 5) rotary-drives the main shaft 74 to drive the needle bar drive mechanism 67. It should be noted that the needle bar drive mechanism 67 may include a lever drive cam 75, a coupling member 76, a jump tie 77, a guide rod 78, and a coupling pin (not shown), etc. The rotary-driving force of the main shaft 74 may be transmitted via the lever drive cam 75 to the coupling member 76. As a result, the jump tie 77, on which the coupling member 76 may be pivotally supported, may be driven up and down as it is guided by the guide rod 78, which may be disposed in parallel with the needle bar 27. Then, this up-and-down driving force may be transmitted via the coupling pin (not shown) to the needle bar 27, thereby driving up and down the needle bar 27 to which the sewing needle 19 may be attached. On the other hand, the revolving force of the main shaft 74 may be transmitted to the shuttle drive mechanism 58 to rotary-drive the shuttle 59. In such a manner, the sewing needle 19 and the shuttle 59 are driven in synchronization with each other, thereby forming stitches to the work cloth.

Further, when the boring apparatus 30 is attached to the rightmost needle bar 27, the following operations are performed to form an eyelet in accordance with sewing data containing boring setting data (which is described later). First, the needle bar case 15 may be moved right and left to select a needle bar 27, which may be assigned needle bar No. 1, to which the boring apparatus 30 is attached. Then, the main shaft 74 is rotary-driven by the sewing machine motor 54 to drive the needle bar drive mechanism 67, thereby lowering the needle bar 27. As the needle bar 27 is lowered, the presser 35 lowers together with the boring knife 33. During the course of the lowering, the grip ring 36 of the presser 35 may be engaged via the work cloth 90 with the grip plate 39 of the needle plate 28. As the needle bar 27 is further lowered, the spring 37 involutes to press the presser 35 downward, then the grip ring 36 and the grip plate 39 annually sandwich the work cloth 90 via the taper surface 361 and the grip surface 391. The cutting tooth 332 of the boring knife 33 is lowered out from the cavity 353 of the presser 35, and runs through the sandwiched work cloth 90 into the escape hole 38 and the through-hole 392, thereby making an eyelet in the work cloth 90.

Figure 5:
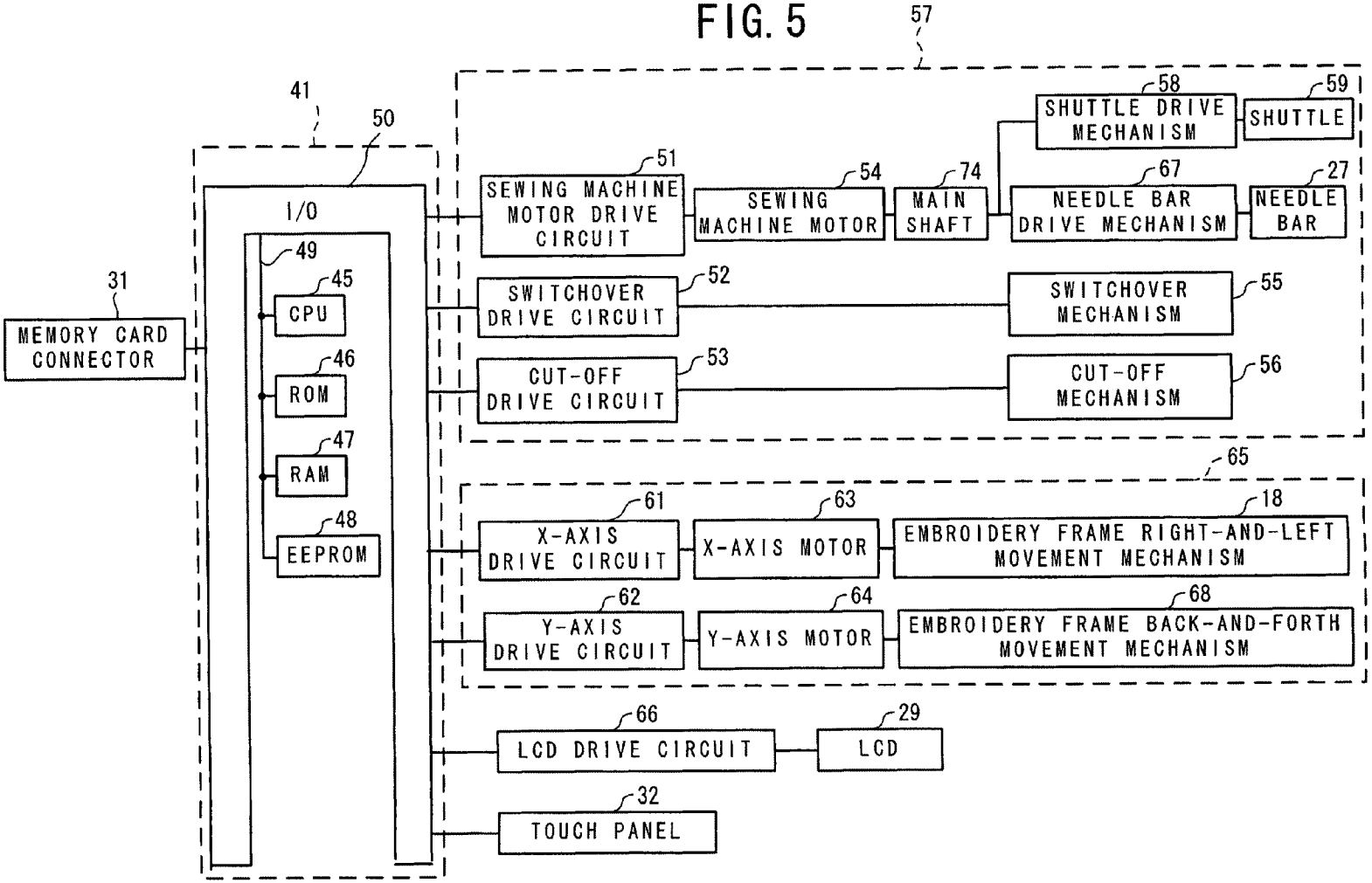
FIG. 5 is a block diagram showing an electrical configuration of the multi-needle type embroidery sewing machine.
Figure 6:
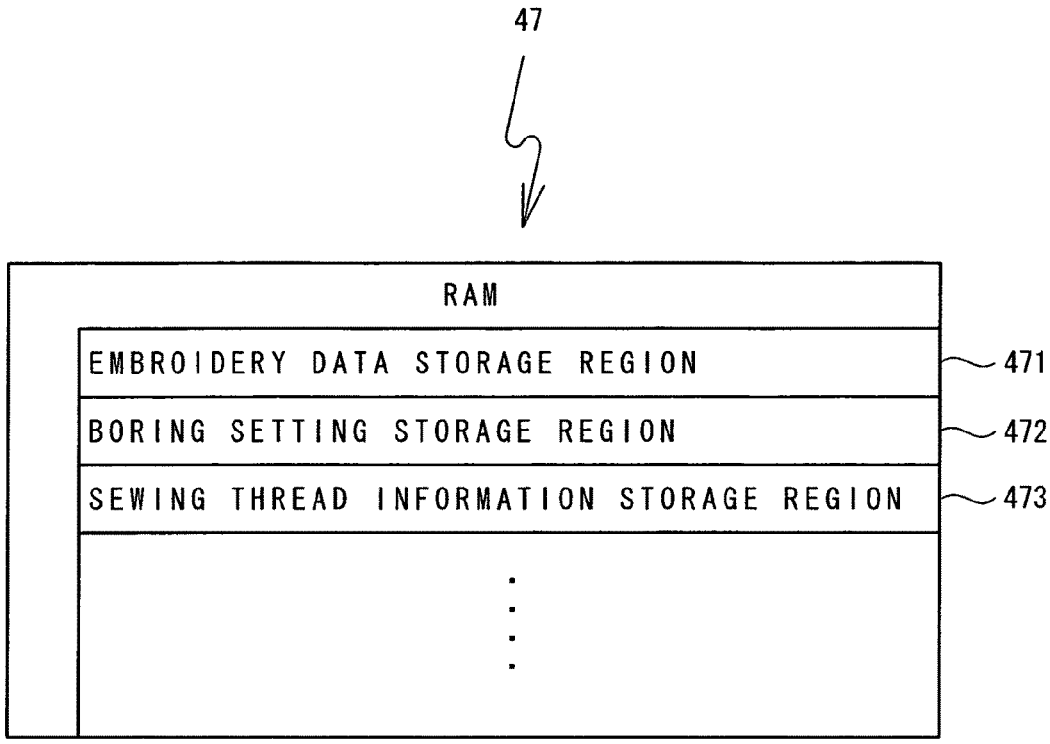
FIG. 6 is a conceptual diagram showing storage regions of a RAM.

Next, an electrical configuration that enables control of the multi-needle type embroidery sewing machine 11 is described below with reference to FIGS. 5-7. As shown in FIG. 5, the multi-needle type embroidery sewing machine 11 may be represented by a sewing machine drive portion 57, an embroidery frame drive portion 65, a control unit 41, etc. Hereinafter, the sewing machine drive portion 57, the embroidery frame drive portion 65, and the control unit 41 that includes the multi-needle type embroidery sewing machine 11 is described in detail respectively.

The sewing machine drive portion 57 may be equipped with the sewing machine motor 54 and a sewing machine motor drive circuit 51. The sewing machine motor 54 rotary-drives the main shaft 74, while the sewing machine motor drive circuit 51 drives the sewing machine motor 54 in accordance with a control signal from the control unit 41. The revolving force of the main shaft 74 may be transmitted to the shuttle drive mechanism 58 and to the needle bar drive mechanism 67. The shuttle drive mechanism 58 may drive the shuttle 59, which contains the bobbin for bobbin thread (not shown) around which a bobbin thread is wound. The needle bar drive mechanism 67 may drive the needle bar 27 up and down. Further, the sewing machine drive portion 57 may be equipped with a switchover mechanism 55 and a switchover drive circuit 52. The switchover mechanism 55 may alternately switch between the needle bars 27. The switchover drive circuit 52 may drive the switchover mechanism 55 in accordance with the control signal from the control unit 41. Further, the sewing machine drive portion 57 may be equipped with a cut-off mechanism 56 and a cut-off drive circuit 53. The cut-off mechanism 56 may cut off a needle thread and/or a bobbin thread if sewing ends or a jump of the thread occurs. The cut-off drive circuit 53 may drive the cut-off mechanism 56 in accordance with the control signal from the control unit 41.

The embroidery frame drive portion 65 may be equipped with the X-axis motor 63 and the X-axis drive circuit 61. The X-axis motor 63 drives the embroidery frame right-and-left movement mechanism 18, which moves the embroidery frame (not shown) in the right and left direction. The X-axis drive circuit 61 drives the X-axis motor 63 in accordance with the control signal from the control unit 41. The embroidery frame drive portion 65 may be further equipped with the Y-axis motor 64 and the Y-axis drive circuit 62. The Y-axis motor 64 may drive the embroidery frame back-and-forth movement mechanism 68, which moves the embroidery frame right-and-left movement mechanism 18 back and front to which the embroidery frame (not shown) is set. The Y-axis drive circuit 62 may drive the Y-axis motor 64 in accordance with the control signal from the control unit 41.

The control unit 41 may included a CPU 45, a ROM 46, a RAM 47, an EEPROM 48, an input/output interface (I/O) 50, etc., which may be connected to each other via a bus 49. Besides the sewing machine drive portion 57 and the embroidery frame drive portion 65, the memory card connector 31, the touch panel 32, and an LCD drive circuit 66 that controls the LCD 29, are each connected to the input/output interface 50.

The CPU 45 may conduct main control on the multi-needle type embroidery sewing machine 11, to perform various kinds of operations and routines in accordance with a sewing control program stored in the ROM 46, which may be a memory device. Further, the CPU may perform various kinds of operations and routines in accordance with an embroidery data processing program according to the present disclosure. It should be noted that those programs may be stored in the EEPROM 48. Further, the programs may be stored in an external storage device such as a memory card, in which case those programs are read into the RAM 47 and then the programs are executed.

In the ROM 46, an overall thread information table may be stored that includes lists information that indicates the type of the multi-needle type embroidery sewing machine 11, information of the size of sewing areas, basic information such as the number of the needle bars employed, and all pieces of thread information about a plurality of kinds of threads, which are used in sewing. The overall thread information table may be composed of thread information pieces that correspond to thousands of kinds of threads. The thread information about each of the threads may include a thread information No., a manufacturer's name, a thread color, a name, a thickness, a material, etc.

The RAM 47, which may be a random access memory, may include storage regions to store data used for the sewing and boring setting. The RAM 47 is described in detail below with reference to FIG. 6. As shown in FIG. 6, in the storage regions of the RAM 47, there are a sewing data storage region 471, a boring setting storage region 472, and sewing thread information storage region 473. The sewing data storage region 471 stores the sewing data (embroidery data) of a selected embroidery pattern. The sewing data may include the thread information (data of a thread color, a thread kind, a thread No., etc.) of a thread to be used in embroidery and needle drop point data comprised of an X-Y positional coordinate of the embroidery frame. The boring setting storage region 472 may store whether the boring apparatus 30 is attached, where data may be shifted that corresponds to a boring setting, and the RGB-values of a color for which boring setting is made. The sewing thread information storage region 473 may store the thread-specific information contained in the sewing data, which may include the data of the thread color (RGB-values), the order of sewing, the No. of the needle bar to be used and a boring flag that indicates whether the data corresponds to a boring setting.

The sewing data storage region 471 may store such sewing data, as shown in FIG. 7. The sewing data may include information (which is described as "COLOR CHANGEOVER" in FIG. 7) that specifies a thread color or a thread and a needle drop point (which is described as "SEWING DATA" in FIG.

7) that may be expressed in an X-Y positional coordinate. As described later, the sewing data of a specific color contained in the sewing data may provide boring data that provides instructions to make a cut with the boring knife 33.

Next, a procedure for sewing an embroidery pattern and making a cut in the work cloth 90 with the boring apparatus 30 by using the multi-needle type embroidery sewing machine 11, is described below with reference to FIGS. 8-18. It should be noted that programs for executing a main routine shown in FIG. 9, a setting routine shown in FIG. 1, a reading routine shown in FIG. 13, a boring setting routine shown in FIG. 14, and a sewing setting routine shown in FIG. 17, respectively, are stored in the ROM 46 beforehand and executed by the CPU 45, that is shown in FIG. 4.

Figure 8:
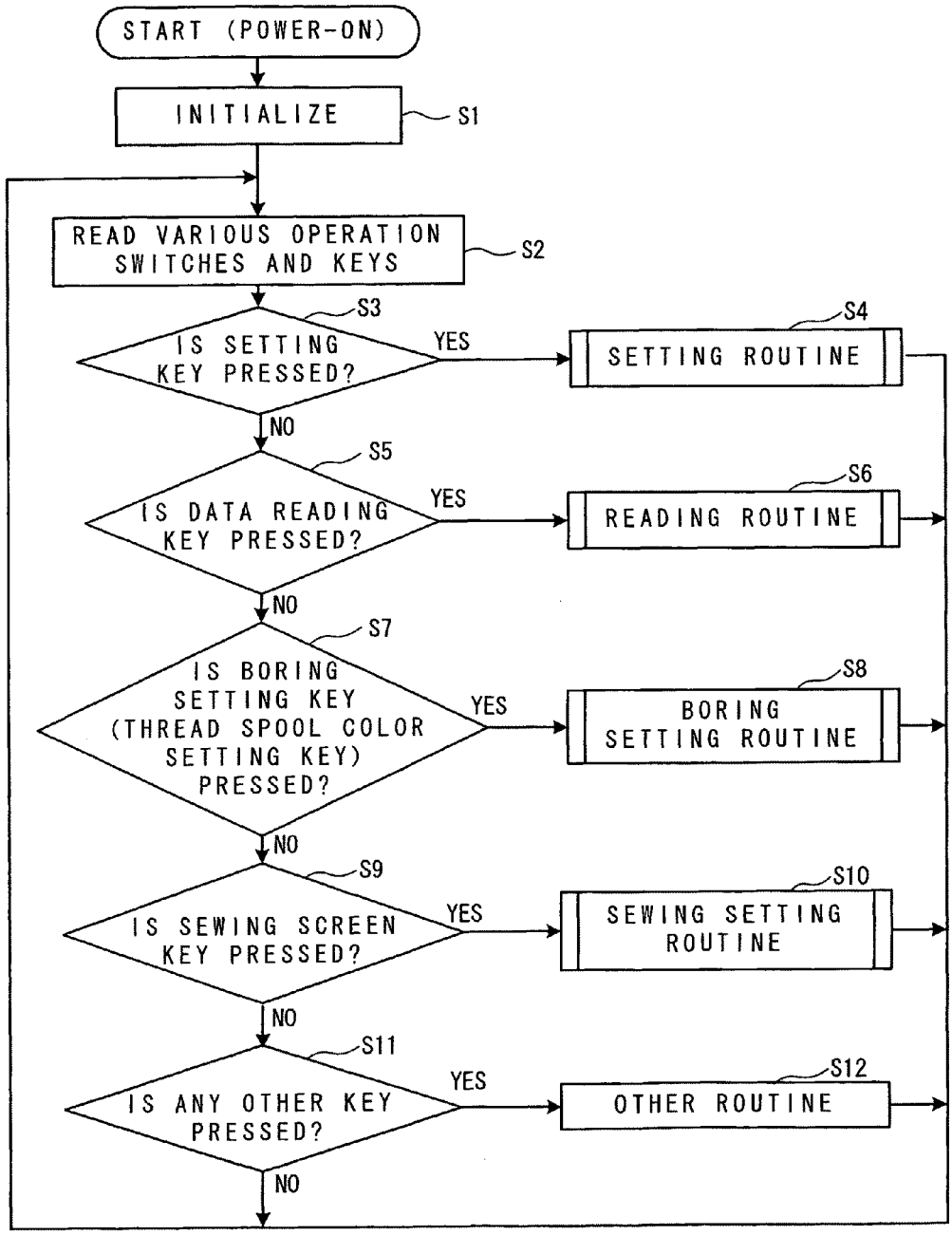
FIG. 8 is a flowchart showing a flow of a main routine for the multi-needle type embroidery sewing machine.
Figure 9:
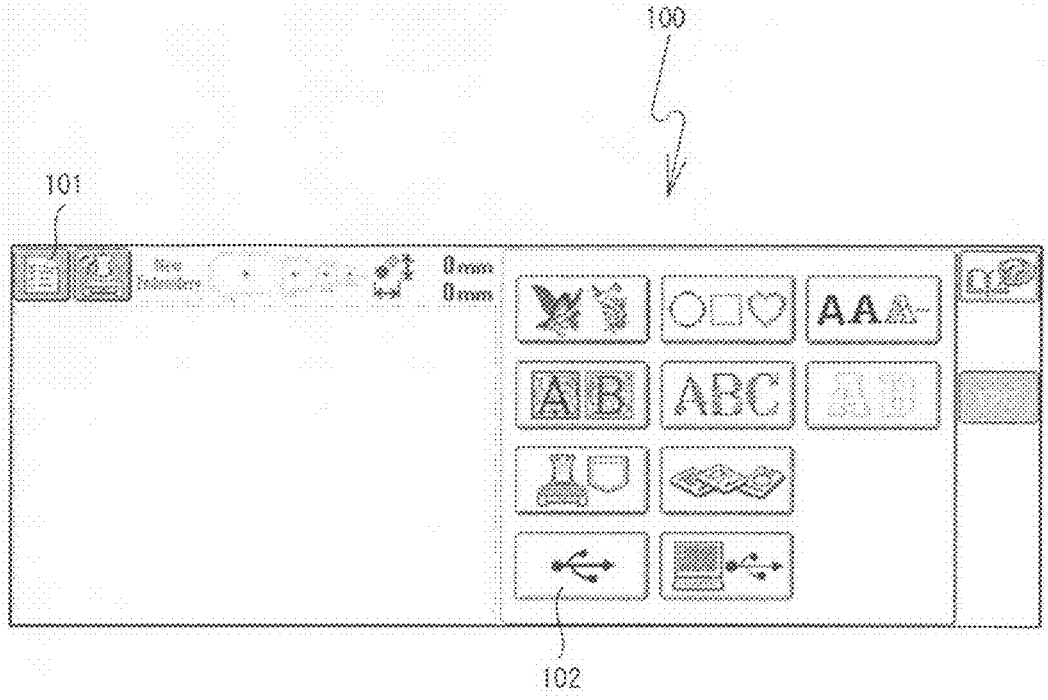
FIG. 9 is an explanatory illustration showing an example of an initial screen.

As shown in FIG. 8, when the power of the multi-needle type embroidery sewing machine 11 is turned ON, the process first performs initialization to erase data in the storage regions of the RAM 47, to read various default values from the ROM 46 and to set them, etc., in step 1 (S1). Then, an initial screen 100 such, as shown in FIG. 9, appears on the LCD 29. The initial screen 100 has on it a setting key 101 for entering a setting screen on which the setting of the attachment of the boring apparatus 30 and various other kinds of settings can be made, a reading key 102 for reading embroidery pattern data, and various kinds of operation keys to select an embroidery pattern, display an operation procedure, etc. Next, the process reads the entry through the touch panel 32 of the various keys displayed on the LCD 29 and the entry of other operation switches and keys of the multi-needle type embroidery sewing machine 11 in step 2 (S2).

Figure 10:
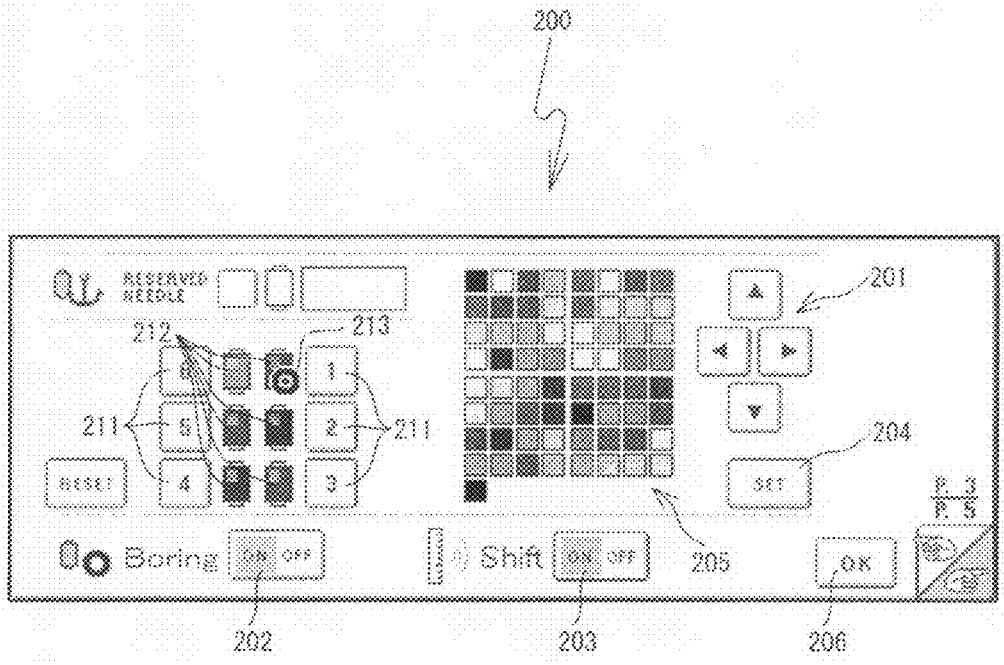
FIG. 10 is an explanatory illustration showing an example of a setting screen.

Subsequently, the process determines whether the entered key that is read at S2 is the setting key 101 in step 3 (S3). If the entered key is the setting key 101, then the process displays a setting screen 200, as shown in FIG. 10, and executes the setting routine in accordance with FIG. 11. Now, the setting routine is described below with reference to FIGS. 10 and 11.

As shown in FIG. 10, the setting screen 200 displays, in its left side, needle bar Nos. 211 of the six needle bars 27 of the multi-needle type embroidery sewing machine 11, and thread information 212 of the threads which are set to those needle bars 27, respectively. The thread information 212 may be displayed with an illustration of the thread spools having their respective thread colors. If the boring setting is made, a boring setting display 213 may be superimposed on the thread information 212. Around the midsection of the setting screen 200, a color palette 205 may be displayed that lists the thread colors of the overall thread information table stored in the ROM 46, so that the operator can select his/her desired color by using color selection keys 201, that include upward, downward, rightward, and leftward cursors. By selecting one of the needle bar Nos. 211, selecting a color by the color selection keys 201, and then pressing a set key 204, the operator can specify the desired color to that No. of the needle bar. Besides the above keys, at the lower part of the setting screen 200, a boring apparatus attachment key 202, a shift setting key 203, and an OK key 206 are available. The boring apparatus attachment key 202 may be used to specify whether to attach the boring apparatus. The shift setting key 203 may be used to specify whether to shift the boring data. The OK key 206 may be used to validate all settings after they are made.

Figure 11:
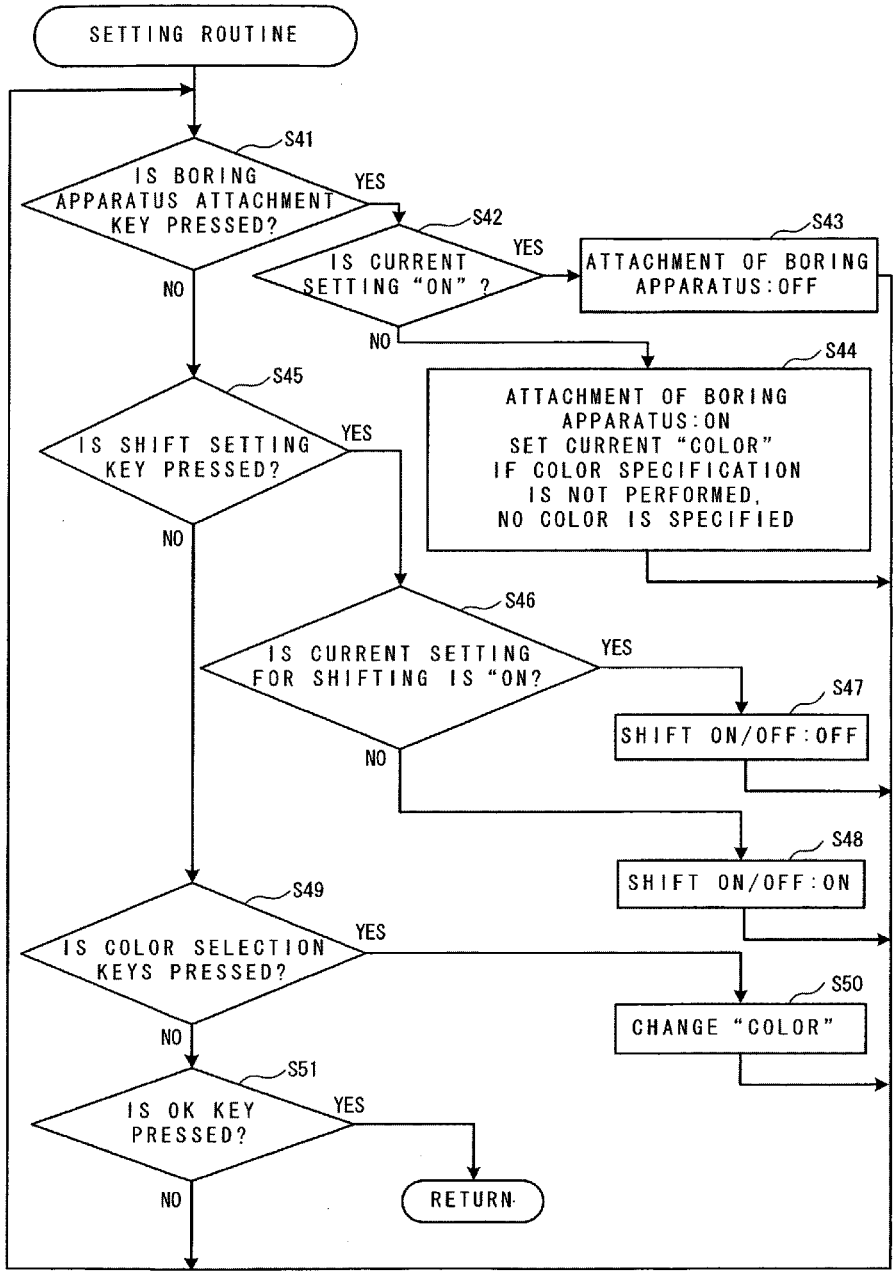
FIG. 11 is a flowchart of a setting routine which is executed in a main routine.

In the setting routine, as shown in FIG. 11, the process first determines whether the boring apparatus attachment key 202 is pressed in step 41 (S41). Each time that the boring apparatus attachment key 202 is pressed, the attachment of the boring apparatus will be switched alternately between "ON" and "OFF." With this, if the boring apparatus attachment key 202 is pressed (YES at S41), the process then checks the boring setting storage region 472 of the RAM 47 to determine whether the current setting is "ON" in step 42 (S42). If the current setting for attachment is "ON (YES at S42), as the boring apparatus attachment key 202 is pressed, the process determines that the setting for attachment is switched from the ON state to the OFF state and accordingly stores the OFF state for attachment in the boring setting storage region 472 in step 43 (S43). Then, the process returns to S41.

On the other hand, if the current setting for attachment is OFF (NO at S42), the process stores the ON state for attachment in the boring setting storage region 472. In this case, if no color is specified by the color selection keys 201, the process determines that no color is specified. In the present example, because the boring apparatus 30 may always be attached to the needle bar 27 having needle bar No. 1, the process stores the RGB-values of a color set to the current needle bar No. 1 in the boring setting storage region 472 in step (S44). Then, the process returns to S41.

If the boring apparatus attachment key 202 is not pressed (NO at S41), the process then determines whether the shift setting key 203 is pressed in step 45 (S45). As such, the tip of the cutting tooth 332 of the boring knife 33 is deviated forward from the central axis line of the needle bar 27 by a predetermined distance, as shown in FIG. 4. That is, the shift setting key 203 may be used to make a setting on whether to shift boring data by as much as this predetermined distance. If the setting is "ON", the boring data will be shifted, and if the setting is "OFF", the boring data will not be shifted. Like the boring apparatus attachment key 202, each time the shift setting key 203 is pressed, the setting will be switched alternately between "ON" and "OFF." With this, the process then checks the boring setting storage region 472 of the RAM 47 to determine whether the current setting is "ON" in step 46 (S46). If the current setting for shifting is "ON (YES at S46), the process determines that the setting for shifting is "OFF" and stores it in the boring setting storage region 472 in step 47 (S47). Then, the process returns to S41. On the other hand, if the current setting for shifting is "OFF" (NO at S46), the process determines that the setting for shifting is "ON" and stores it in the boring setting storage region 472 in step 48 (S48). Then, the process returns to S41.

If the shift setting key 203 is not pressed (NO at S45), the process then determines whether any one of the color selection keys 201 is pressed in step 49 (S49). If the color selection key 201 is pressed (YES at S49), the process changes the color to be selected, in accordance with the pressed key in step 50 (S50). Then, the process returns to S41.

If the color selection keys 201 is not pressed, the process determines whether the OK key 206 is pressed in step 51 (S51). If the OK key 206 is not pressed (NO at S51), the process returns to S41 again to repeat the above processing. If the OK key 206 is pressed (YES at S51), the process returns to the main routine. It should be noted that, although not shown, if any other key is pressed, the process executes a routine that is assigned to that key.

When the setting routine ends, the process returns to S2 in the main routine (see FIG. 8.) and repeats the routine to read the switches and the keys. If the setting key is not read (NO at S3), the process then determines whether the data reading key 102 arranged on the initial screen 100 is read in step 5 (S5). If the data reading key 102 is read (YES at S5), the process executes the reading routine shown in FIG. 13.

Figure 12:
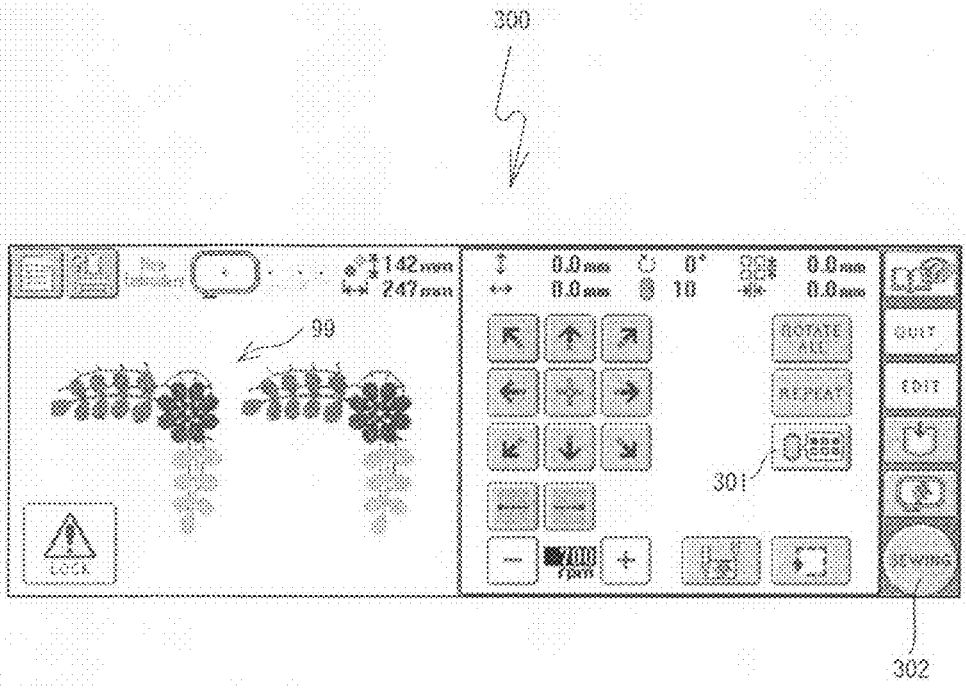
FIG. 12 is an explanatory illustration showing an example of a screen on which pattern data has been read.
Figure 13:
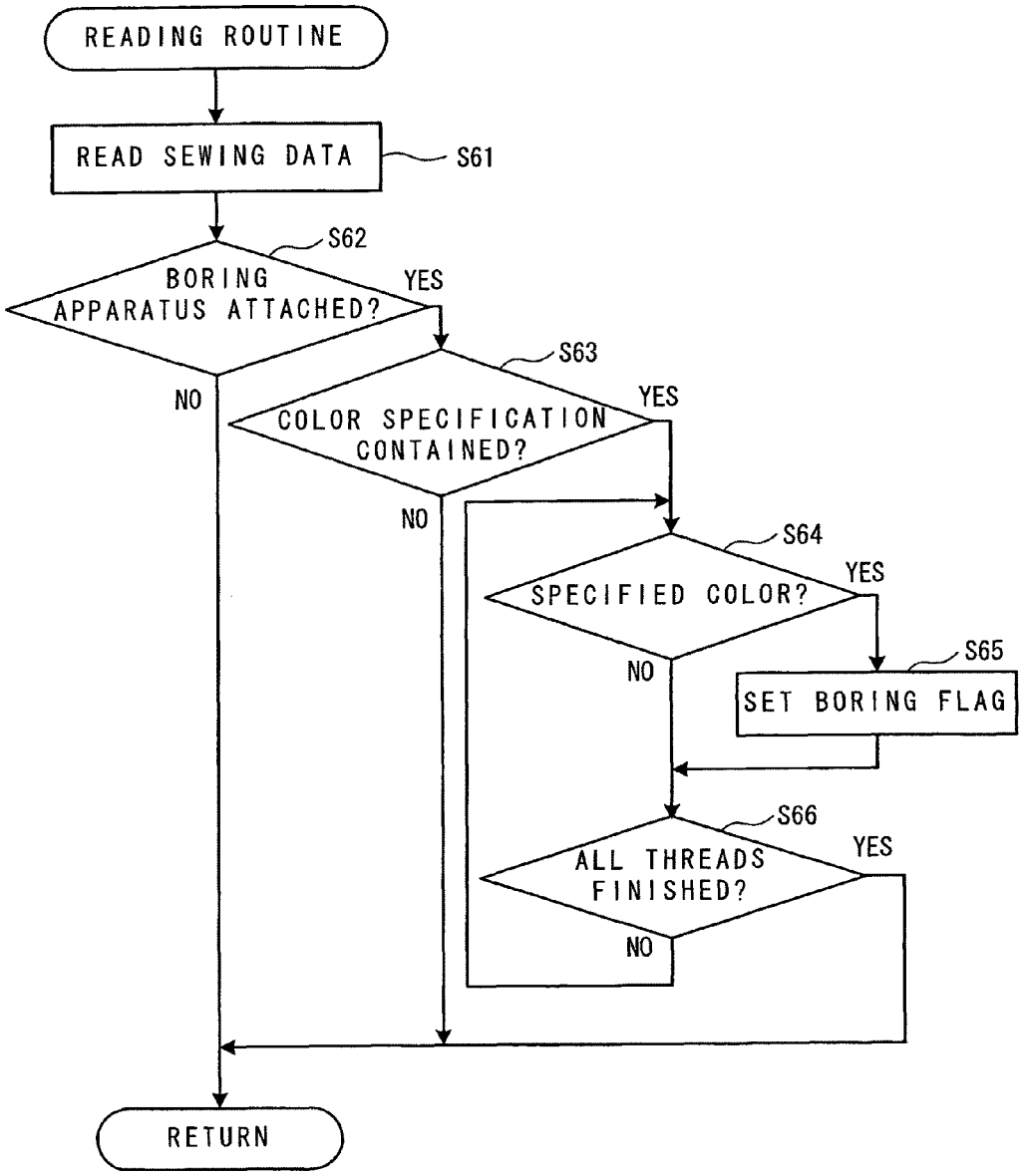
FIG. 13 is a flowchart of a reading routine which is executed in the main routine.

In the reading routine, as shown in FIG. 13, the process first reads the sewing data of a specified pattern into the sewing data storage region 471 from the ROM 46, an embroidery card (memory card) inserted to the memory card connector 31, a personal computer connected to a USB connector (not shown), etc. The read sewing data may be displayed as a selected pattern 99 in the left side of a reading screen 300, as shown in FIG. 12, in step 61 (S61). Next, the process checks the boring setting storage region 472 and determines whether the attachment of the boring apparatus is set to ON in step 62 (S62). If the attachment of the boring apparatus is set to OFF (NO at S62), the process directly returns to the main routine.

If the attachment of the boring apparatus is set to ON (YES at S62), the process then determines whether the boring setting contains the specification of a color, based on what is stored in the boring setting storage region 472 in step 63 (S63). If no color is specified in the boring setting (NO at S63), the process directly returns to the main routine. If a color is already specified in the boring setting (YES at S63), then the process sequentially checks thread color data pieces contained in the read sewing data (see FIG. 7) and determines whether any one of them refers to the color specified in the boring setting in step 64 (S64). If the thread color data contained in the read sewing data refers to that color specified in the boring setting (YES at S64), the process sets the boring flag to ON for the relevant thread in the sewing thread information storage region 473 in step 65 (S65). This processing may be repeated until this determination is made for all of the threads whose data is contained in the sewing data in step 66 (S66). If the determination is made on all of the threads, the process returns to the main routine.

When the reading routine ends, the process returns to S2 in the main routine (see FIG. 8) and repeats the routine to read the switches and the keys. If the data reading key 102 is not read (NO at S5), the process then determines whether the boring setting key 301 (see FIG. 12) arranged on the reading screen 300 is read in step 7 (S7). If the boring setting key 301 is read (YES at S7), the process displays a boring setting screen 400 shown in FIG. 15 and executes the boring setting routine shown in FIG. 14.

Figure 15:
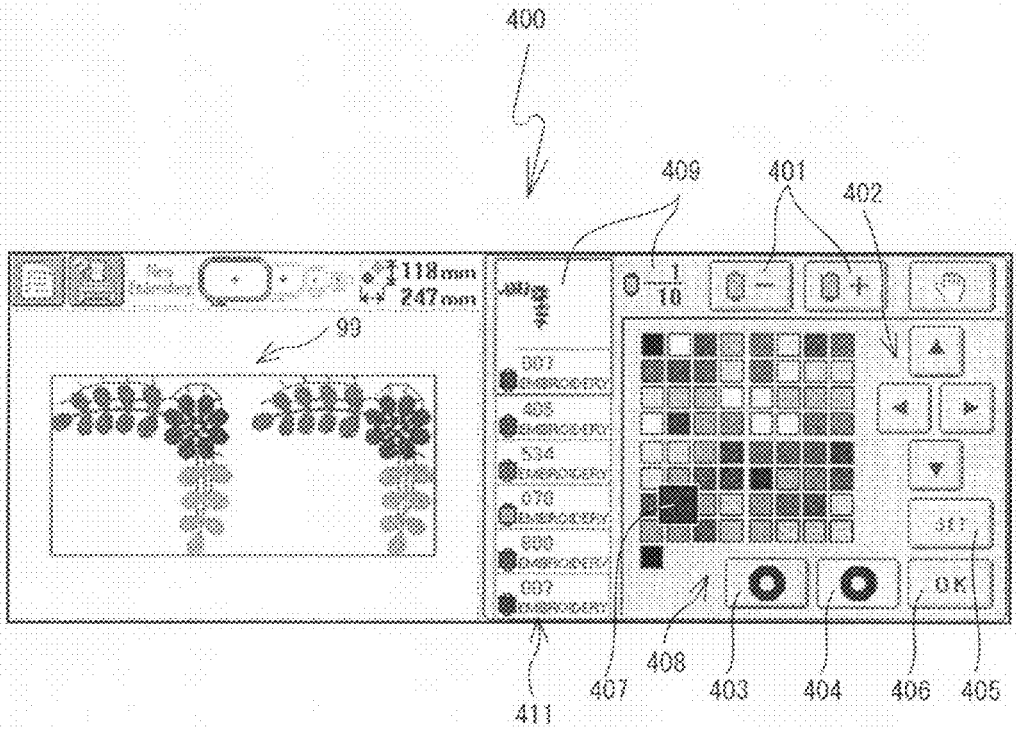
FIG. 15 is an explanatory illustration showing an example of a boring setting screen.

As shown in FIG. 15, the boring setting screen 400 displays the selected pattern 99 in its left side and, at its midsection, a sewing order 411 in which the sewing threads are arranged in descending order from the top. At the upper right part of the screen, thread selection keys 401 may be arranged to move up and down the thread to be selected in the sewing order 411. It should be noted that the currently selected thread may be indicated by a selected thread indicator 409 arranged to the left of the thread selection key, based on the sewing order (in an example of FIG. 15, the first thread in the sewing order is currently selected from among 10 candidates). Further, to the right of the sewing order 411, a color palette 408 may be arranged that corresponds to thread colors stored in the overall thread information table. A desired color can be selected using color selection keys 402 of upward, downward, rightward, and leftward cursors arranged to the right of the color palette 408. The selected color may be displayed as a specified color 407 in a large size on the color palette. At the lower right part of the screen, a boring color setting key 403 and a boring batch setting key 404 are arranged. By selecting a specific thread in the sewing order 411 with the thread selection key 401 and pressing the boring color setting key 403, the selected thread can be set as being subject to the boring. Further, by selecting a color with the color selection key 402 and pressing the boring batch setting key 404, the threads having that color are retrieved and all the threads having the color in the sewing order 411 are set to ON, so that they may be subject to the boring.

Figure 14:
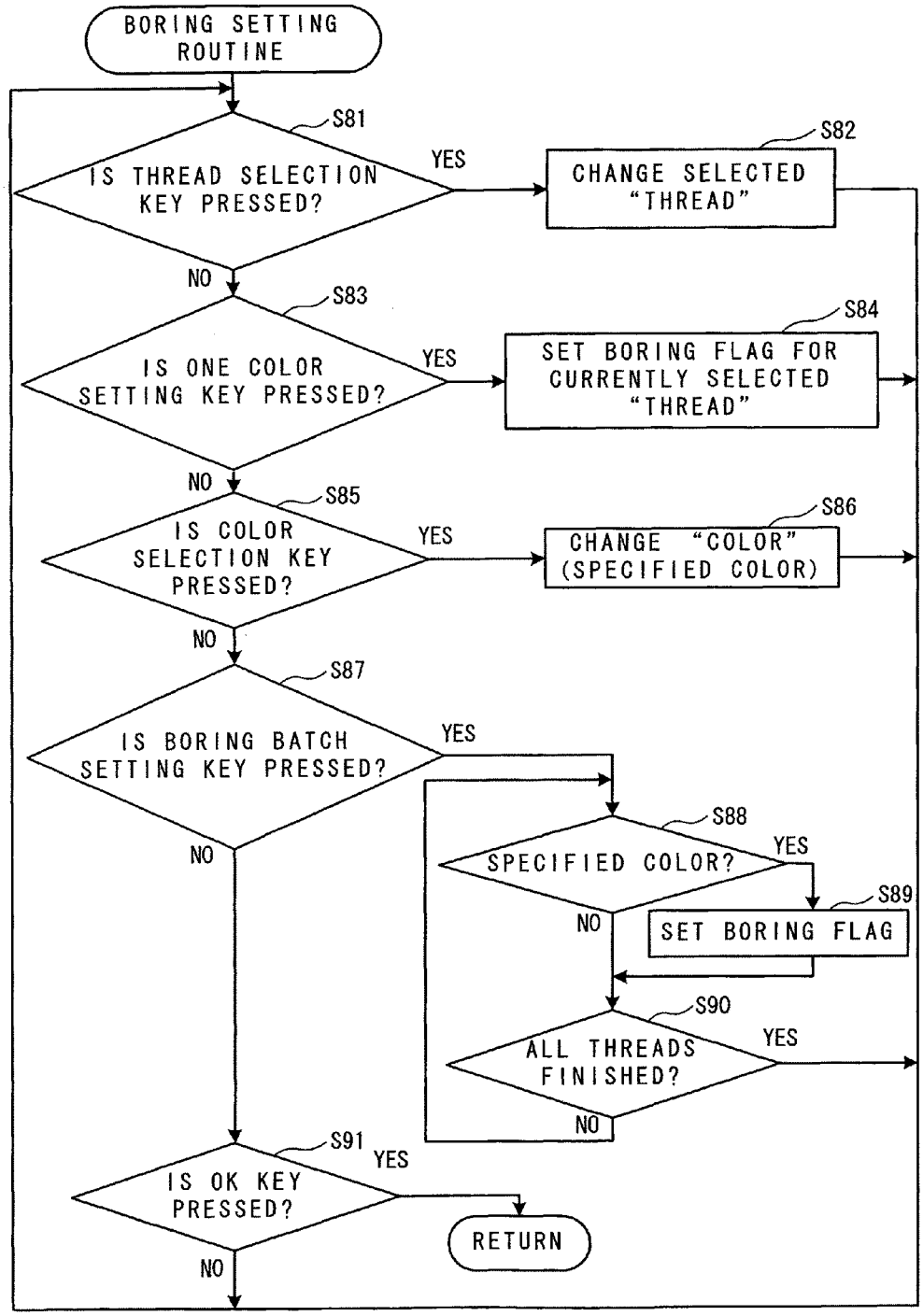
FIG. 14 is a flowchart of a boring setting routine which is executed in the main routine.

Specifically, as shown in FIG. 14, the process first determines whether the thread selection key 401 is pressed in step 81 (S81). If the thread selection key 401 is pressed (YES at S81), the process changes the currently selected thread in the sewing order 411 and displays a new thread at the selected thread indicator 409 in step 82 (S82). Then, the process returns to S81.

Figure 16:
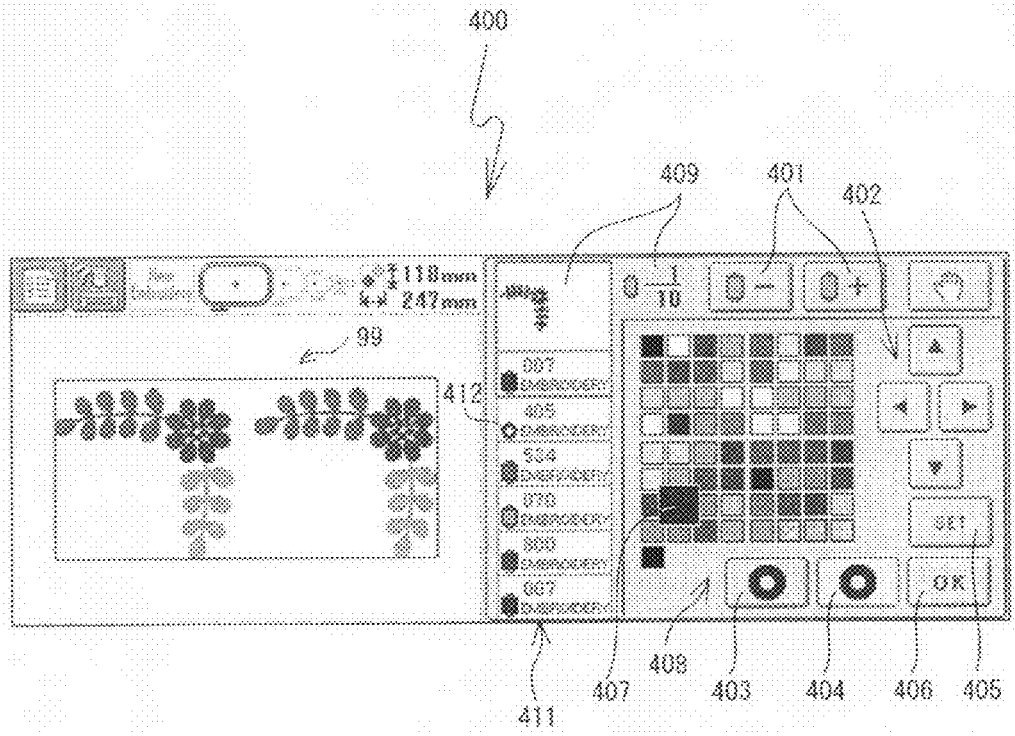
FIG. 16 is an explanatory illustration showing an example of a boring setting screen on which boring settings are displayed.

If the thread selection key 401 is not pressed (NO at S81), the process then determines whether the boring color setting key 403 is pressed in step 83 (S83). If the boring color setting key 403 is pressed (YES at S83), the process sets the boring flag to ON for the currently selected thread (thread currently indicated by the selected color indicator 409) and stores it in the sewing thread information storage region 473 in step 84 (S84). In such a manner, a thread that is currently selected is set for boring and, as shown in FIG. 16, the illustration in the sewing order 411 is changed from a thread spool icon to an eyelet icon 412. Then, the process returns to S81. Thus, if boring setting is performed using the boring color setting key 403, the boring flag for only a thread which is currently selected is set to ON, so that even if there are any other threads in the sewing order having the same color as that of the currently selected thread, the boring flags for those threads remain OFF. Therefore, even the threads that have the same color can be divided into those for boring setting and those for ordinary setting in sewing, depending on the order in which they are used in sewing.

If the boring color setting key 403 is not pressed (NO at S83), the process then determines whether the color selection key 402 is pressed in step 85 (S85). If the color selection key 402 is pressed (YES at S85), the process changes the specified color 407 and displays it in step 86 (S86). Then, the process returns to S81.

If the color selection key 402 is not pressed (NO at S85), the process then determines whether the boring batch setting key 404 is pressed in step 87 (S87). If the boring batch setting key 404 is pressed (YES at S87), the process then sequentially checks the types (thread colors) of the threads specified in the read sewing data (see FIG. 7) and determines whether the color is specified in the boring setting in step 88 (S88). If the color is coincident with the specified color (YES at S88), the process sets ON the boring flag for this thread in the sewing thread information storage region 473 in step 89 (S89). The illustration in the sewing order 411 for the thread whose boring flag is set to ON is changed from the thread spool icon to the eyelet icon 412. This processing may be repeated until this determination is made on all of the threads specified in the sewing data in step 90 (S90). When the determination made on all of the threads (YES at S90), the process returns to S81.

If the boring batch setting key 404 is not pressed (NO at S87), the process then determines whether the OK key 406 is pressed in step 91 (S91). If the OK key 406 is not pressed (NO at S91), the process returns to S81. If the OK key is pressed (YES at S91), the process finalizes the selected settings and returns to the main routine (see FIG. 8).

In the main routine processing, after the boring setting routine ends, the process returns to S2 and performs a routine to read the various switches and keys. If the boring setting key 301 is not read (NO at S7), the process determines whether the sewing screen key 302 is pressed on the reading screen 300 in step 9 (S9). If the sewing screen key 302 is pressed (YES at S9), the process displays a sewing setting screen 500 shown in FIG. 18 and executes the sewing setting routine shown in FIG. 17, in step 10 (S10).

The sewing setting screen 500 displays the selected pattern 99 in its left side and, at its midsection, the sewing order 411 in which sewing threads are arranged in descending order from the top. A needle bar indicator 413 may be disposed to the right of the sewing order 411, that indicates the No. of the needle bar 27 that corresponds to the thread. Further, a needle bar key 501 indicating a needle bar No. and a thread indicator 502 adjacent to the needle bar key 501, are disposed in the right of the screen. The thread indicator 502 indicates the No. or the kind of a thread that is attached to each needle bar 27. And next to the thread indicator 502, a thread spool indicator 503 may be disposed that illustrates the icon of a thread spool in a color, which corresponds to the color of the thread. Further, if a boring setting is made, a boring setting indicator 504 may be superimposed on the thread spool indicator 503.

Figure 17:
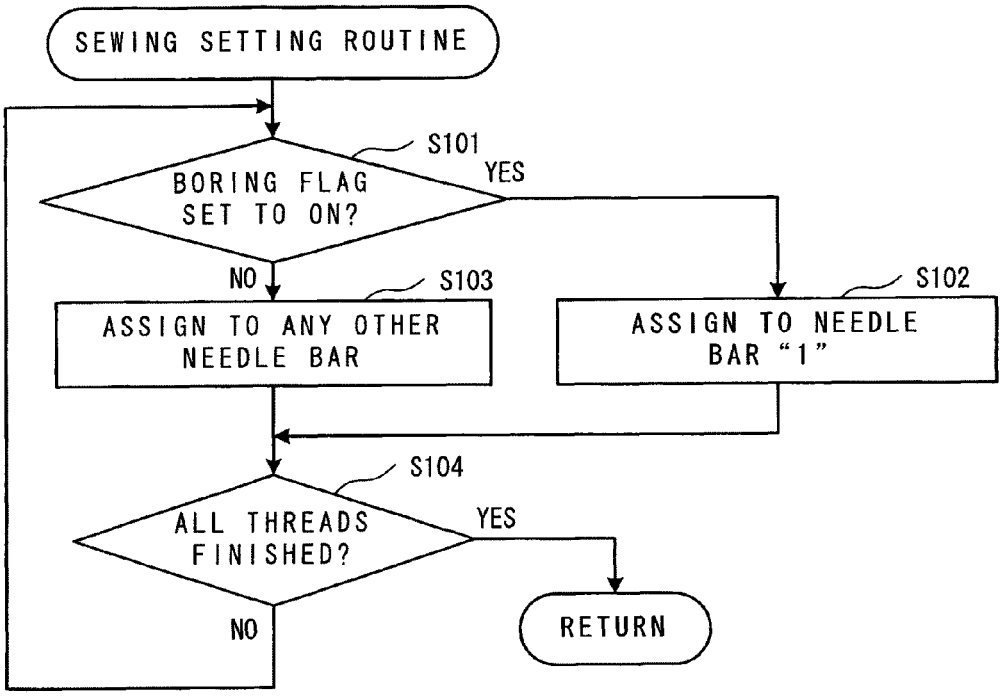
FIG. 17 is a flowchart of a sewing setting routine which is executed in the main routine.
Figure 18:
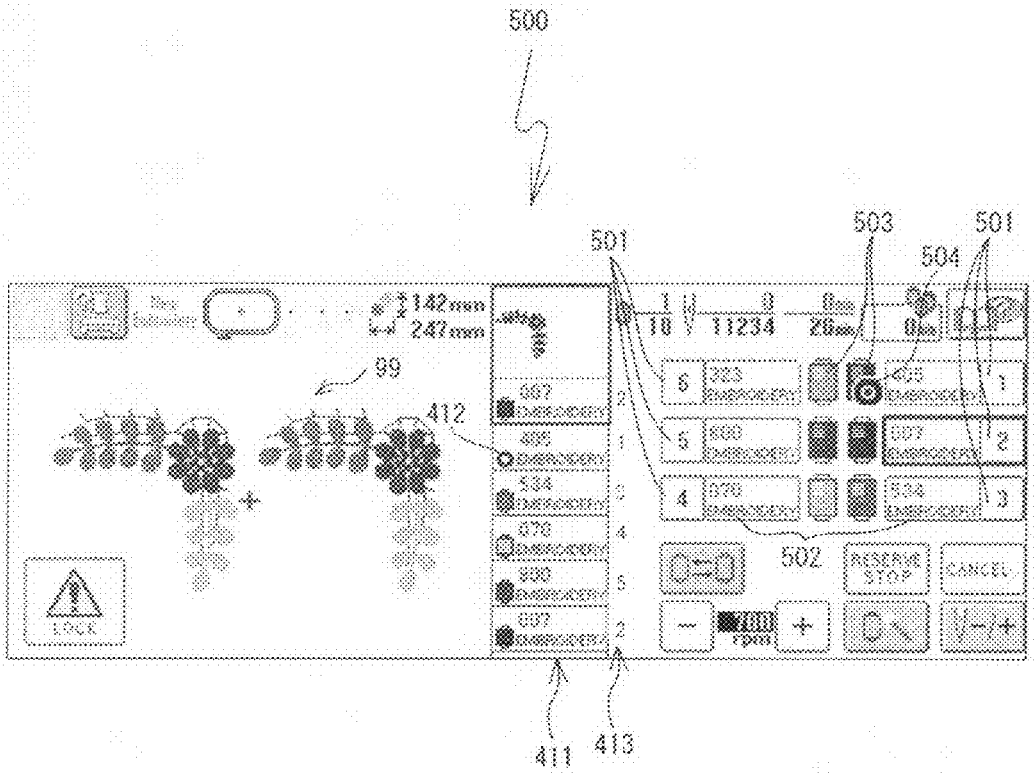
FIG. 18 is an explanatory illustration showing an example of a sewing setting screen.

As shown in FIG. 17, in the sewing setting routine, the process performs processing to sequentially assign the threads to the needle bars. The data of threads may be contained in sewing data, which may be read in the sewing data storage region 471 and may be stored in the sewing thread information storage region 473. The process first determines whether the boring setting flag is set to ON for a target thread in step 101 (S101). If the boring setting flag is ON (YES at S101), the process assigns that thread to the No. 1 needle bar 27 in step 102 (S102), because the boring apparatus can be attached to only the No. 1 needle bar 27 in the present example.

If the boring setting flag for the processing target thread is OFF (NO at S101), the process assigns that thread to a thread other than the No. 1 needle bar 27 in step 103 (S103). In this example, the thread may be assigned to the lower numbered needle bars sequentially or, if any other needle bar has the same kind of thread attached thereto, may be assigned to the needle bar 27, preferentially. This processing may be repeated until it is completed on all of the threads in step 104 (S104). When the processing is completed on all of the threads (YES at S104), the process returns to the main routine (see FIG. 8).

In the main routine, after the sewing setting routine ends, the process returns to S2 and performs the routine to read the various switches and keys. If the sewing screen key 302 is not read (NO at S9), the process determines whether any other key is pressed in step 11 (S11). If any other key is pressed (YES at S11), the process performs processing that corresponds to that key in step 12 (S12) and returns to S2 to perform the routine to read the various switches and keys. If no other key is pressed (NO at S11), the process returns to S2 to perform the routine to read the various switches and keys. In such a manner, in the main routine, the process reads the operation switch or the key and repeats the corresponding processing. It should be noted that the sewing operation may be performed as any other processing (S12) by reading a sewing start switch or a sewing stop switch.

By the above processing, the sewing data of a specific color can be subjected to a boring setting, so that even without preparing for making a boring setting each time the sewing process encounters the data for boring, by preparing coordinate data for boring in the form of sewing data in which the specific color is specified, the sewing order of that color can be set for boring to thereby embroider the work cloth 90 and make a cut in it with the boring knife 33. Further, two sewing data boring specification methods are made available of specifying a specific color for a boring setting before reading sewing data and specifying a specific color or thread for a boring setting after reading sewing data, so that the operator can make a boring setting at one of these times or by using one of those methods whichever the user finds is easier for him/her.

As described above, in the embroidery data processing apparatus of the present disclosure, needle drop point data that corresponds to the data of a specified color is set in the boring data, so that the boring data can be set simultaneously regardless of the sewing order, or no matter whether a plurality of specified colors of data is contained in the acquired embroidery data.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data processing apparatus which processes embroidery data that is used to sew an embroidery to a work cloth and make a cut by a boring knife, the embroidery data processing apparatus comprising:

an embroidery data acquisition device that acquires the embroidery data, pieces of the embroidery data including at least thread color data and needle drop point data specifying a sewing position where sewing is performed with embroidery thread specified by the thread color data;

a specification device that specifies a user desired thread color data piece of thread color data pieces that are included in the embroidery data acquired by the embroidery data acquisition device; and a boring data setting device that sets a needle drop point data piece corresponding to the thread color data piece specified by the specification device, as boring data that specifies a position where the cut is made by the boring knife.

2. The embroidery data processing apparatus according to claim 1, further comprising:

a thread selection device that selects at least one thread color data piece out of the thread color data pieces included in the acquired embroidery data, wherein the specification device specifies the thread color data selected by the thread selection device as the specified color data.

3. An embroidery sewing machine that sews an embroidery to a work cloth which has a cut made by a boring knife, the embroidery sewing machine comprising:

a sewing device that forms stitches;

a movement device that moves the work cloth;

the embroidery data processing apparatus according to claim 2;

a boring knife that makes a cut in the work cloth;

a boring control device that makes the cut in the work cloth by moving the work cloth with the movement device while moving the boring knife up and down based on boring data which is set by the boring data setting device; and an embroidery control device that controls the sewing device and the movement device based on the acquired embroidery data so that embroidery may be performed.

4. The embroidery data processing apparatus according to claim 1, further comprising:

a color selection device that selects a user desired color, wherein if the thread color data of the color selected by the color selection device is included in the acquired embroidery data, the specification device specifies the thread color data as the specified color data.

5. An embroidery sewing machine that sews an embroidery to a work cloth which has a cut made by a boring knife, the embroidery sewing machine comprising:

a sewing device that forms stitches;

a movement device that moves the work cloth;

the embroidery data processing apparatus according to claim 4;

a boring knife that makes a cut in the work cloth;

a boring control device that makes the cut in the work cloth by moving the work cloth with the movement device while moving the boring knife up and down based on boring data which is set by the boring data setting device; and an embroidery control device that controls the sewing device and the movement device based on the acquired embroidery data so that embroidery may be performed.

6. An embroidery sewing machine that sews an embroidery to a work cloth which has a cut made by a boring knife, the embroidery sewing machine comprising:

a sewing device that forms stitches;

a movement device that moves the work cloth;

the embroidery data processing apparatus according to claim 1;

a boring knife that makes a cut in the work cloth;

a boring control device that makes the cut in the work cloth by moving the work cloth with the movement device while moving the boring knife up and down based on boring data which is set by the boring data setting device; and an embroidery control device that controls the sewing device and the movement device based on the acquired embroidery data so that embroidery may be performed.

7. An embroidery data processing apparatus that processes embroidery data used to sew an embroidery to a work cloth and make a cut by a boring knife, the embroidery data processing apparatus comprising:

a thread color data storage device that stores pieces of thread color data;

a specification device that specifies a user desired thread color data piece of the thread color data pieces stored in the thread color data storage device;

an embroidery data storage device that stores pieces of the embroidery data, which includes at least the thread color data and needle drop point data specifying a sewing position where sewing is performed with the embroidery thread specified by the thread color data;

an embroidery data selection device that selects a user desired embroidery data from among embroidery data pieces stored in the embroidery data storage device; and a boring data setting device, wherein the boring data setting device sets the needle drop point data corresponding to the specified color data as boring data which specifies a position where the cut is made by the boring knife, if there is the specified color data specified by the specification device in the thread color data of the embroidery data selected by the embroidery data selection device.

8. An embroidery sewing machine that sews an embroidery to a work cloth which has a cut made by a boring knife, the embroidery sewing machine comprising:

a sewing device that forms stitches;

a movement device that moves the work cloth;

the embroidery data processing apparatus according to claim 7;

a boring knife that makes a cut in the work cloth;

a boring control device that makes the cut in the work cloth by moving the work cloth with the movement device while moving the boring knife up and down based on boring data which is set by the boring data setting device; and an embroidery control device that controls the sewing device and the movement device based on the acquired embroidery data so that embroidery may be performed.

9. A non-transitory computer-readable recording medium storing a control program for use in an embroidery data processing apparatus that processes embroidery data used to sew an embroidery to a work cloth and make a cut by a boring knife, the control program comprising:

embroidery data acquisition instructions for acquiring the embroidery data, pieces of the embroidery data including at least thread color data and needle drop point data specifying a sewing position where sewing is performed with embroidery thread specified by the thread color data;

specification instructions for specifying a user desired thread color data piece of thread color data pieces included in the embroidery data acquired by the embroidery data acquisition instructions; and boring data setting instructions for setting a needle drop point data piece corresponding to the thread color data piece specified by the specification instructions, as boring data that specifies a position where the cut is made by the boring knife.

10. The recording medium according to claim 9, further comprising:

thread selection instructions for selecting at least one thread color data piece out of the thread color data pieces included in the acquired embroidery data, wherein the specification instructions specify the thread color data selected by the thread selection instructions as the specified color data.

11. The recording medium according to claim 9, further comprising:

color selection instructions for selecting a user desired color, wherein if the thread color data of the color selected by the color selection instructions is included in the acquired embroidery data, the specification instructions specify the thread color data as the specified color data.

12. A non-transitory computer-readable recording medium storing a control program for use in an embroidery data processing apparatus which processes embroidery data used to sew an embroidery to a work cloth and make a cut by a boring knife, the control program comprising:

thread color data storage instructions for storing pieces of thread color data;

specification instructions for specifying a user desired thread color data piece of the thread color data pieces stored by the thread color data storage instructions;

embroidery data storage instructions for storing pieces of the embroidery data which includes at least the thread color data and needle drop point data specifying a sewing position where sewing is performed with the embroidery thread specified by the thread color data;

embroidery data selection instructions for selecting a user desired embroidery data from among embroidery data pieces stored by the embroidery data storage instructions; and boring data setting instructions for setting needle drop point data corresponding to the specified color data as boring data which specifies a position where the cut is made by the boring knife, if there is the specified color data specified by the specification instructions in the thread color data of the embroidery data selected by the embroidery data selection instructions.

* * * * *